US005987147A

United States Patent [19]

Nishimoto

[11] Patent Number: 5,987,147

[45] Date of Patent: Nov. 16, 1999

[54] SOUND COLLECTOR

[75] Inventor: Hirofumi Nishimoto, Kanagawa, Japan

[73] Assignee: Sony Corporation, Tokyo, Japan

[21] Appl. No.: 09/124,045

[22] Filed: Jul. 29, 1998

[30] Foreign Application Priority Data

Jul. 31, 1997 [JP] Japan ..... 9-329377

[51] Int. Cl.[6] ..... H04R 25/00

[52] U.S. Cl. ..... 381/375; 381/370; 381/374

[58] Field of Search ..... 381/370, 371, 381/374, 375, 71.6, 72, 74, 309, 91, 92, 313, FOR 149, FOR 150; 379/430, 431, 432, 433

[56] References Cited

U.S. PATENT DOCUMENTS 3,306,991 2/1967 Wood ..... 381/72

5,495,534 2/1996 Inanaga et al. ..... 381/74

5,764,778 6/1998 Zurek ..... 381/370

*Primary Examiner*—Huyen Le

*Attorney, Agent, or Firm*—Jay H. Maioli

[57] ABSTRACT

A sound collector which enables users to easily hear a sound from the front of the user's head when mounted on the user's head. The sound collector includes right and left hunger blocks provided at the ends of a headband to be mounted on the user's head, right and left microphone units for collecting an external sound, right and left loud speaker units supported on the right and the left hunger blocks for multiplying the external sound collected by the right and the left microphone units and emitting the amplified sound, and a power source block.

4 Claims, 6 Drawing Sheets

SOUND COLLECTOR

BACKGROUND OF THE INVENTION

1. Field of the Invention

The present invention relates to a sound collector which amplifies an external sound of a predetermined frequency band so as to be hearable.

2. Description of the Prior Art

Conventionally, in stereo audio apparatuses such as a disc recording/reproduction apparatus and a tape recorder, a loud speaker apparatus is provided at the front position of an apparatus main body so that a reproduced sound emitted from this loud speaker apparatus is heard.

When a reproduced sound emitted from such a loud speaker apparatus is to be heard by a plurality of persons, some of the persons can hear a sound of a proper volume while the others are obliged to hear a sound of insufficient volume depending on the hearing position.

Moreover, an audio apparatus may be located in a position in the vicinity of an air conditioner or other apparatus which generates a noise. When a reproduced sound from the audio apparatus is overlapped with such a noise, it becomes impossible to hear a desired reproduced sound with a preferable sound quality.

Furthermore, in a lecture auditorium and a theater, there is a case that the sound volume is insufficient for some of the audience and it is difficult to sufficiently hear the voice of a lecturer or an actor/actress.

SUMMARY OF THE INVENTION

It is therefore an object of the present invention to provide a sound collector which enables to eliminate a noise and to surely hear a desired sound.

Another object of the present invention is to provide a sound collector which absorbs a difference in hearing ability, enabling to surely hear a desired sound.

Yet another object of the present invention is to provide a sound collector which enables to surely hear a human voice without being affected by a noise.

In order to achieve the aforementioned objects, the sound collector according to the present invention includes a first microphone unit and a second microphone unit for collecting an external sound through a head band to be mounted on a user's head and a first loud speaker unit and a second loud speaker unit for amplifying the eternal sound collected by these microphone units and emitting the amplified sound, thus enabling to hear the external sound amplified.

Moreover, ear pads are provided at the side of the auricle contact surfaces of housings containing the first and the second loud speaker units so that an external sound is cut off and only the sound emitted from the loud speaker units can be heard.

Furthermore, the first and the second loud speaker units amplify only a sound in the vicinity of approximately 2 to 3 kHz of the sound collected by the first and the second microphone units so that only a human voice can be surely heard without being affected by a noise other than the human voice.

DETAILED DESCRIPTION OF THE PREFERRED EMBODIMENTS

Hereinafter, description will be directed to a sound collector according to the present invention with reference to the attached drawings.

Figure 1:
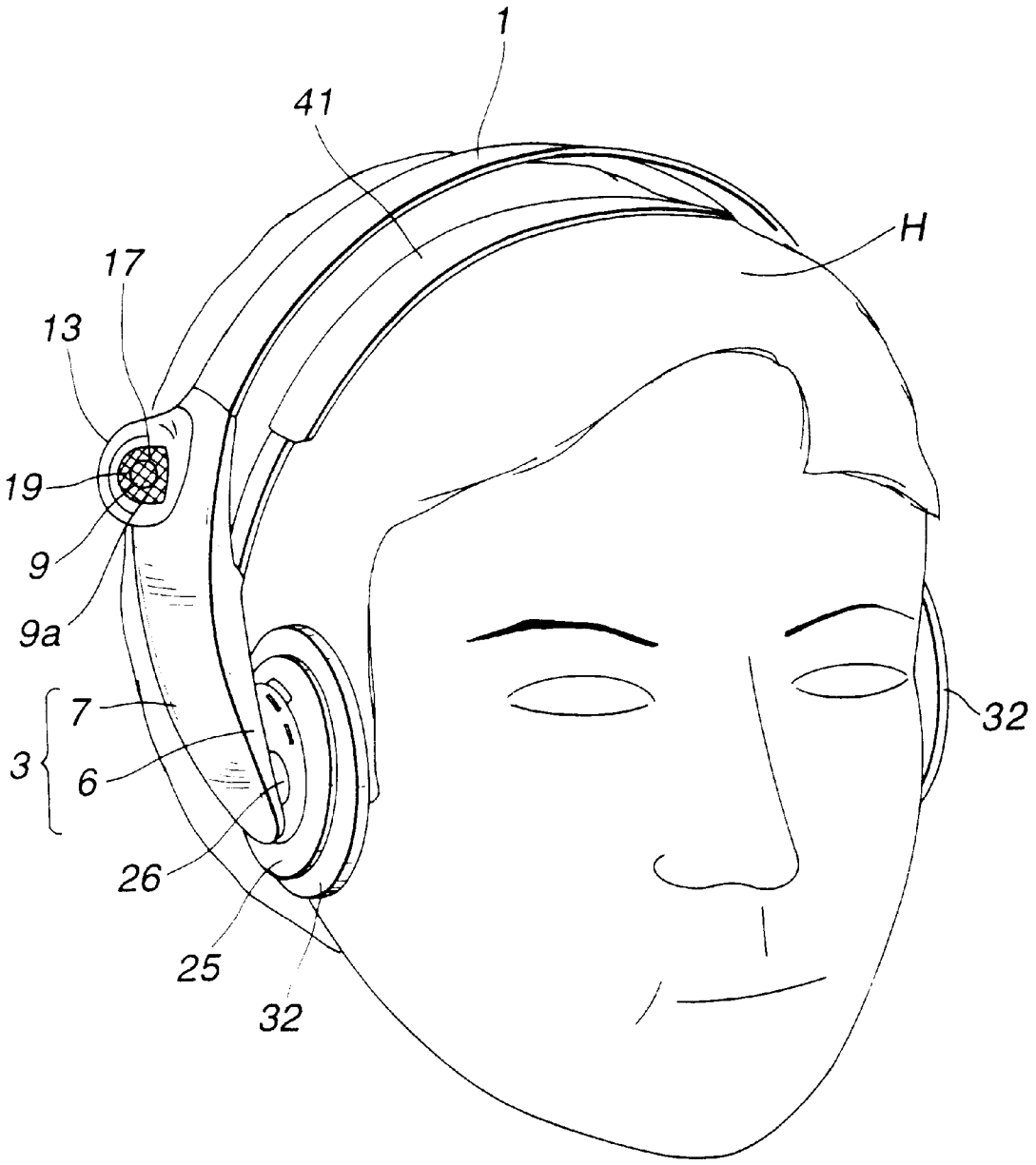
FIG. 1 is a perspective view showing a sound collector according to the present invention mounted on a human head.
Figure 2:
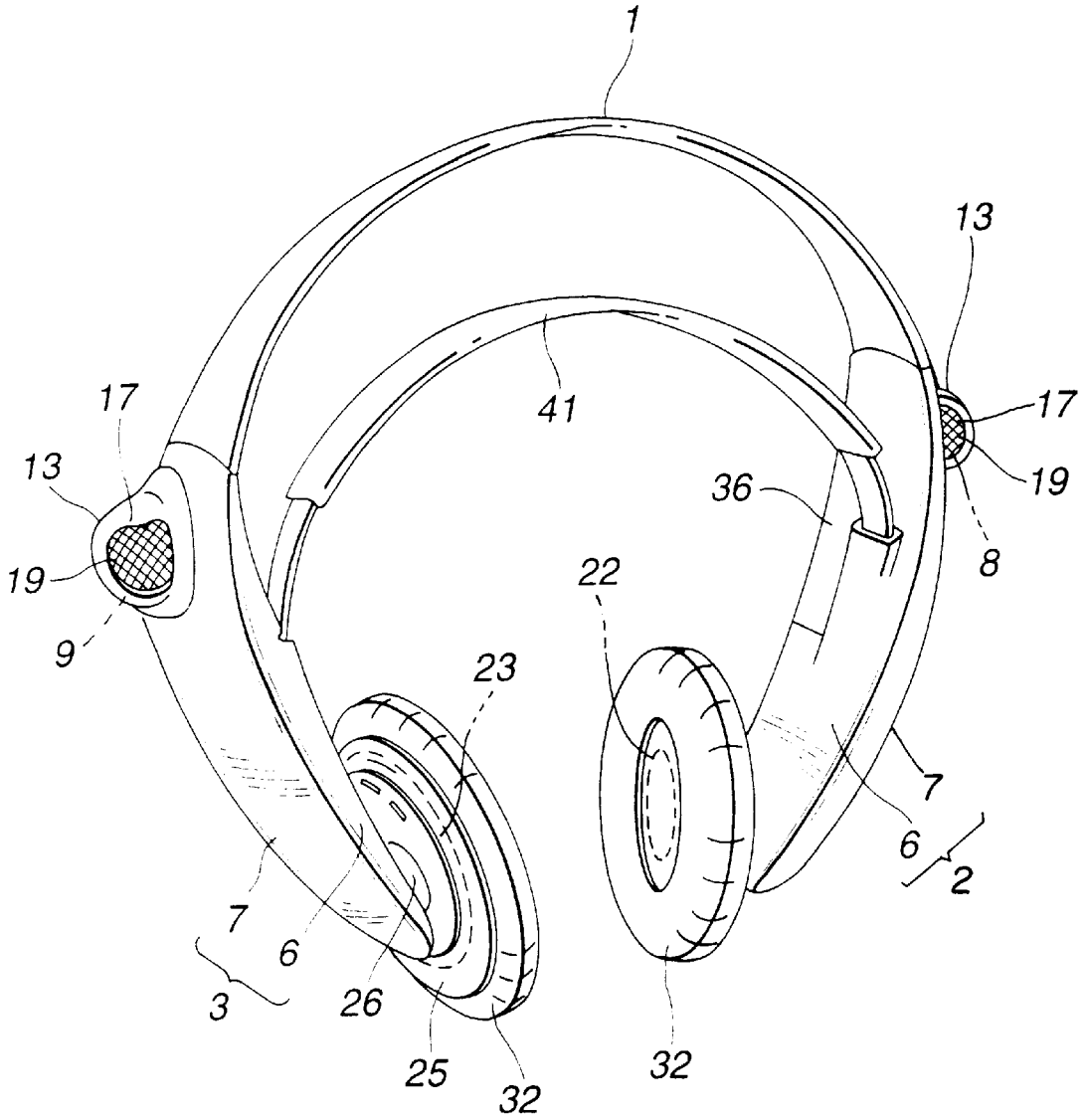
FIG. 2 is a perspective view showing the sound collector according to the present invention removed from the human head.

As shown in FIG. 1 and FIG. 2, the sound collector according to the present invention includes a head band 1 curved along the external configuration of a human head H. This head band 1 is made from a thin plate-shaped synthetic resin body which can be elastically displaced or a leaf spring. The head band 1 made from a leaf spring is coated with a coating material made from a synthetic resin or the like.

Figure 3:
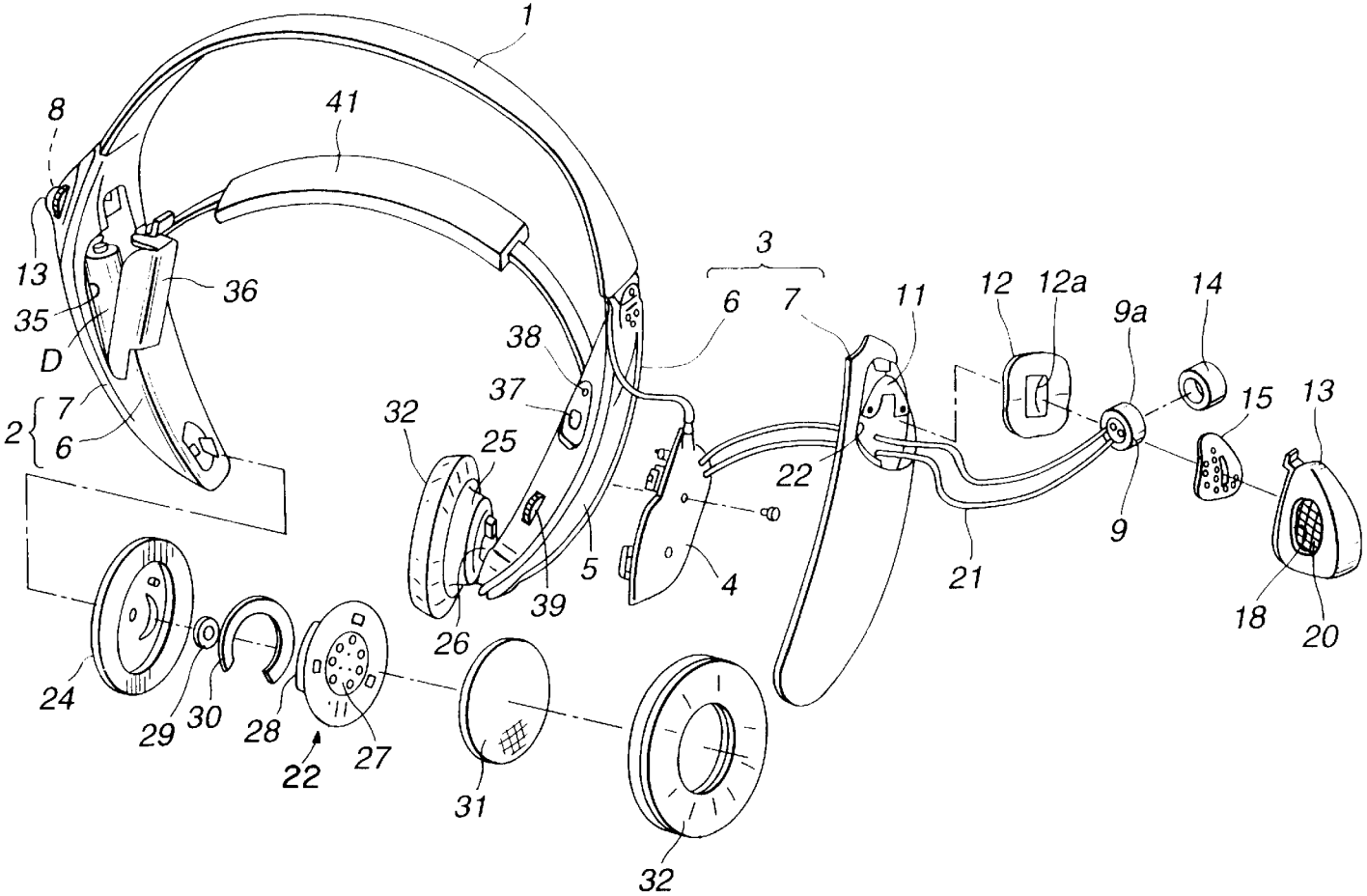
FIG. 3 is an exploded perspective view of the aforementioned sound collector viewed from its back.
Figure 4:
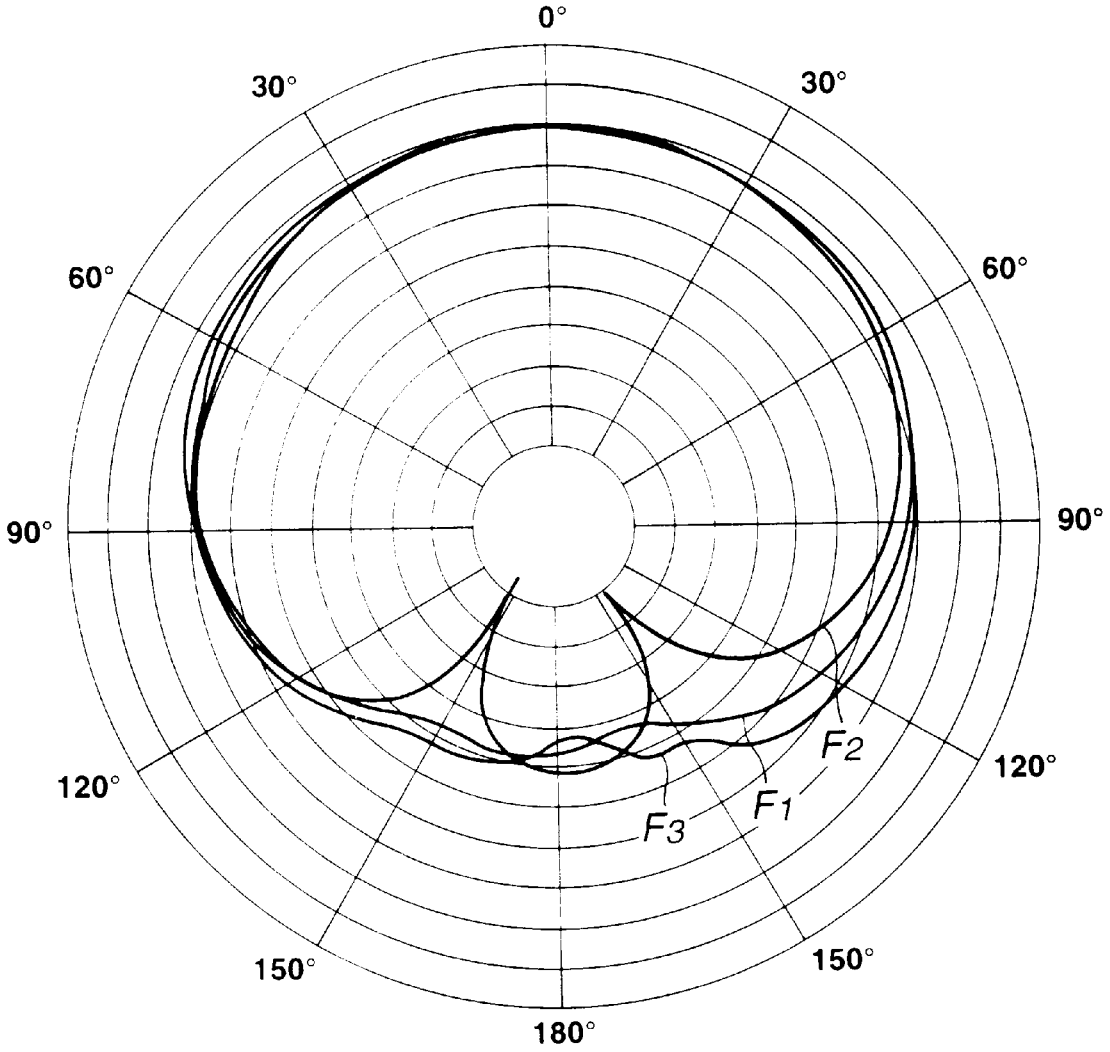
FIG. 4 shows a sound collection characteristic of a microphone unit used in the sound collector according to the present invention.

The both ends of the head band 1 are connected to a first hanger block 2 and a second hanger block 3, respectively. As shown in FIG. 3, each of these hanger blocks consists of a hanger body 6 and a cover member 7 which are connected to each other into a unitary block. The hanger block 6 includes a container block 5 which has a sufficient space for containing a printed circuit board 4 and other electronic components. The cover member 7 covers an opening of the hanger body 6.

In the first and the second hanger blocks 2 and 3, there are provided a first microphone unit 8 and a second microphone unit 9, respectively. In order to collect sound coming into the auricles, these first and second microphone units 8 and 9 are provided in the first and the second hanger blocks 2 and 3, respectively, so as to be positioned in the vicinity of the ears when the sound collector according to the present invention is mounted on the human head H. As shown in FIG. 1, the first and second microphone units 8 and 9 are attached to the outer side of the connection portion of the first and second hunger blocks 2 and 3 to the head band 1.

Here, explanation will given on the mounting of the first and the second microphone units 8 and 9 on the hunger blocks 2, and 3, respectively. Because the first and the second microphone units 8 and 9 are mounted on the respective hanger blocks 2 and 3 with an identical configuration, explanation will be given on the second microphone unit 9 as an example. In FIG. 3, the second microphone unit 9 is placed on a microphone support plate 12 provided in a microphone mounting portion 11 formed on the outer side of the cover member 7 constituting the second hanger block 3. The second microphone unit 9 is supported by a microphone holder 13 to be mounted on the microphone mounting portion 11. Here, the second microphone unit 9 is fitted into an elastic member 14 of cylindrical shape and via this elastic member 14 fitted into a fitting convex 12*a* formed on the microphone support plate 12, so as to be positioned in such a manner that when the sound collector according to the present invention is mounted on a human head, a sound collecting plane 9*a* faces the front of the head.

The elastic member 14 also has a dumping function so that a vibration transmitted via the head band 1 and the second hanger block 3 will not be transmitted to the second microphone unit 9.

Moreover, a microphone stopper plate 15 is provided at the inside of the microphone holder 13. The second microphone unit 9 is fitted into the microphone support plate 12 so as to define the mounting direction and pressed to be supported by the microphone stopper plate 15. Thus, the second microphone unit 9 is positioned and mounted on the second hanger block 3.

It should be noted that an opening 17 is provided at the front side of the microphone holder so as to oppose to the sound collecting plane 9*a* of the second microphone unit 9 mounted on the second hanger block 3, and a metal mesh is provided at a position to oppose the opening 17 of this microphone holder 13. In addition, a rear opening 18 is provided at the rear side of this microphone holder 13. This rear opening 18 is provided with a metal mesh 20 so as to prevent intrusion of dusts into the microphone holder 13. The first microphone unit 8 has a configuration which is right-to-left symmetrical to the configuration of the second microphone unit 9, and is mounted on the first hunger block 2.

Moreover, from the first and the second microphone units 8 and 9 extends an external connection cord 21. This external connection cord 21 is introduced through a cord pull-out hole 22 into the hanger body 6 to be connected to a microphone amplifier constituted on a printed circuit board 4 provided within the hanger body 6 of the second hanger block 3. The connection cord 21 pulled out from the first microphone unit 8 provided in the first hunger block 2 is introduced through the head band 1 and pulled out at the second hanger block 3 to be connected to the printed circuit board 4.

At the tip ends of the first and the second hanger blocks 2 and 3, there are supported a first housing 24 and a second housing 25 containing a first loud speaker unit 22 and a second loud speaker unit 23, respectively. That is, these first and second housings 24 and 25 are arranged so as to face inside of the curved head band 1 so as to oppose each other and are pivotally fixed to the tip ends of the first and the second hanger blocks 2 and 3, so as to be supported in a rotatable state around a pivot 26.

Note that FIG. 3 shows the first loud speaker unit 22 disassembled, and the second loud speaker unit 23 has a configuration which is right-to-left symmetric to the configuration of the first loud speaker unit 22. Each of the first and the second loud speaker units 22 and 23 has a sound emitting plate 27 toward the front of the housings 24 and 25, and contains a magnetic circuit block 28 fitted in the housings 24, 25. It should be noted that a magnetic circuit 28 between the first and the second loud speaker units 22 and 23 is provided with acoustic components 29, 30 made from a material having a certain acoustic resistance such as urethane foam. These acoustic components 29 and 30 function to adjust a frequency characteristic of the sound generated from the first and the second loud speaker units 22 and 23, so as to be an arbitrary characteristic. Moreover, a speaker screen 31 is provided at the front of the first and the second housings 24 and 25 so as to cover the sound emitting plane 27 of the first and the second loud speaker units 22 and 23. This speaker screen 31 is made from an urethane foam or the like having air permeability and serves to protect a diaphragm positioned at the sound emitting plane 27 of the first and the second loud speaker units 22 and 23 as well as to prevent intrusion of dusts into the first and the second loud speaker units 22 and 23.

On the auricle contact side of the first and the second housings 24, and 25, i.e., at the side of the sound emitting plane 27 of the first and the second loud speaker units 22 and 23, there are provided ear pads 32 facing the right and left ears, respectively, to cover the auricles when the sound collector is mounted on the human head H. Each of the ear pads 32 is made from a soft material such as urethane foam having a sound absorbing effect and shaped into a ring shape which is attached to the auricle contact surface of the first and the second housings 24, 25, so as to surround the sound emitting plane 27 of the first and the second loud speaker units 22 and 23. Note that the soft material constituting the ear pads 32 is covered by an external cover made from a synthetic leather.

By providing the ring-shaped ear pads 32 having a sound absorbing effect at the auricle contact side of the first and the second housings 24 and 25, when the sound collector is mounted on a human head, the auricles are covered by the ear pads 32 so as to cut off or attenuate of an external sound coming into the auricles.

Moreover, the first hanger block 2 includes a battery container 35 for containing a battery D serving as a power source for driving the first and the second microphone units 8, 9 and the first and the second loud speaker units 22, 23. This battery container 35 has an interior to receive the battery D and has a cover 36 at its opening to be opened and closed. The battery D contained in the battery container 35 supplies electric power through a connection cord extending through the head band 1 to the first and the second microphone units 8, 9 and the first and the second loud speaker units 22, 23.

On the other hand, the second hanger block 3 includes a power switch 37, power display block 38 made from a light emitting element such as a light emitting diode, and a volume adjusting knob 39 for adjusting outputs of the first and the second microphone units 8, 9.

Inside the inner circumference of the head band 1, there is provided a suspender 41 bridging the first and the second hanger blocks 2 and 3. This suspender 41 is attached so as to be extended and contracted between the first and the second hunger blocks 2 and 3, so that the suspender sits on the user's head in a stable mounting state.

Figure 5:
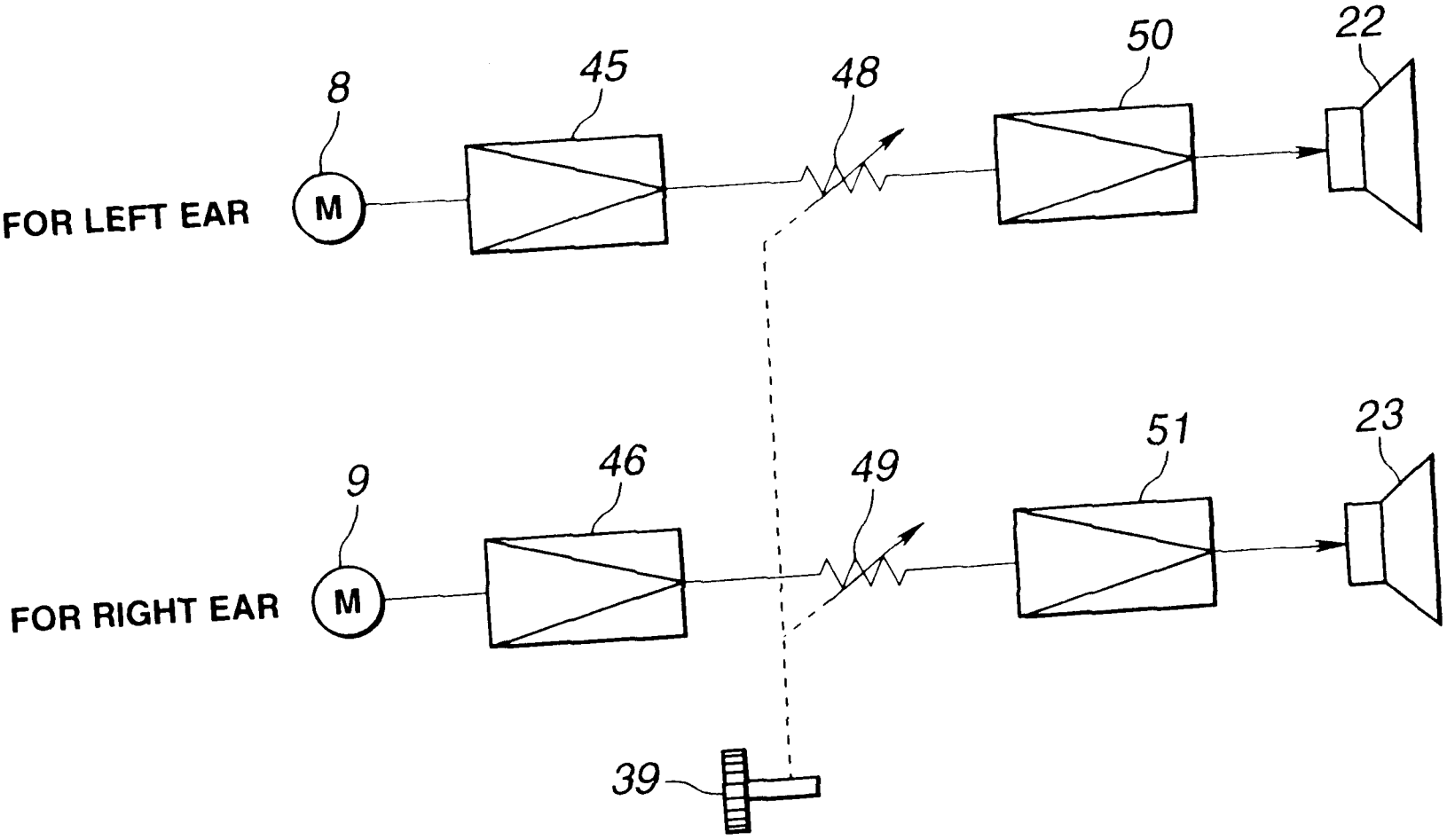
FIG. 5 is a block circuit diagram of the sound collector according to the present invention.

When the sound collector having the aforementioned configuration is mounted on a user's head so that the ear pads 32 cover the right and left auricles, the first and the second microphone units 8 and 9 are positioned in the vicinity of the auricles with the sound collecting planes 9*a* facing forward from the head. As shown in FIG. 5, a sound signal collected by the first and the second microphone units 8 and 9 is amplified by microphone amplifier 45 and 46 constituted on a printed circuit board and supplied via volumes 48, 49 for adjusting an output of a sound signal, to power amplifiers 50, 51 so as to be amplified by these power amplifiers 50, 51 for supply to the first and the second loud speaker units 22, 23 so as to drive the first and the second loud speaker units 22, 23. A reproduced sound emitted from the first and the second loud speaker units 22 and 23 when driven, is emitted to areas defined by the ear pads 32 and introduced into the auricles to be heard.

Figure 6:
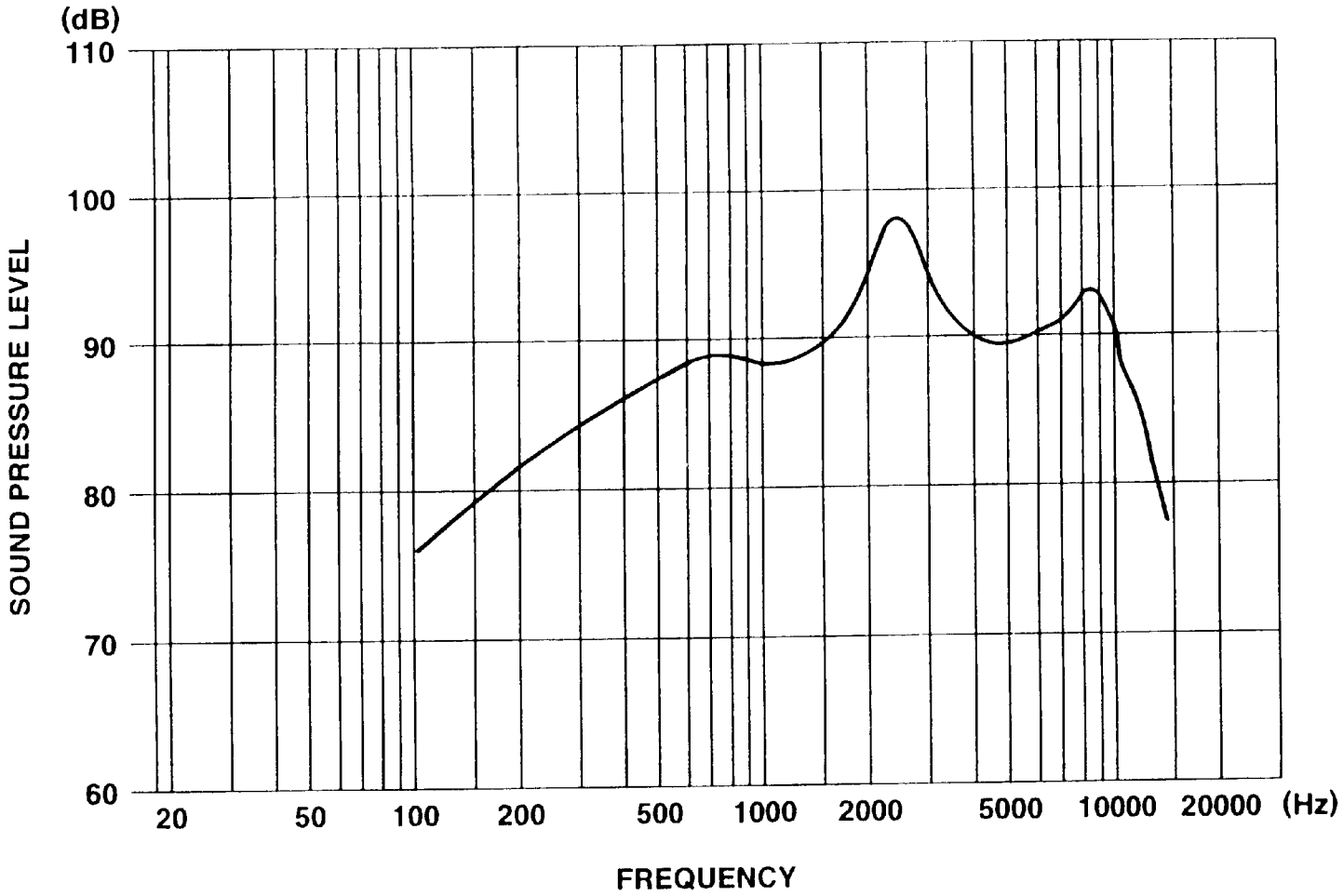
FIG. 6 shows a sound pressure frequency characteristic of a loud speaker unit according to the present invention.

Here, the microphone amplifiers 45, 46 for amplification of a sound signal from the first and the second microphone units 8, 9 to be supplied to the first and the second loud speaker units 22, 23, amplify a sound signal of a frequency band in the vicinity of approximately 2 kHz to 3 kHz and attenuate a sound signal of a frequency band of approximately 500 Hz or below. Because the microphone amplifier 45, 46 have such an amplification function, the first and the second loud speaker units 22, 23 have a sound pressure frequency characteristic as shown in FIG. 6, where a stress is posed on a sound pressure level of a frequency band in the vicinity of approximately 2 to 3 kHz, i.e., the human voice frequency band, while suppressing a sound pressure level of a frequency band of 500 Hz or below such as a noise from an air conditioner or a motor drive sound.

As has been described above, the sound collector according to the present invention includes the first and the second microphone unit for collecting an external sound through the head band mounted on a user's head, and the first and the second loud speaker unit for amplifying the sound collected by these microphone units and emitting the amplified sound. This enables to hear an external sound at an increased level by absorbing a difference in hearing ability and surely hear a desired sound.

The ear pads provided at the auricle contact surface of the housings containing the first and the second loud speaker units enables to cut off a noise coming directly into the auricles, thus enabling to surely hear a desired sound without being affected by a noise.

What is claimed is:

1. A sound collector comprising:

a first hanger block and a second hanger block connected to a first end and a second end, respectively, of a head band mounted on a user's head;

a first microphone unit fitted into a first elastic member and mounted in a fixed position on said first hanger block and a second microphone unit fitted into a second elastic member and mounted in a fixed position on said second hanger block for collecting an external sound;

a first loud speaker unit and a second loud speaker unit respectively contained in a first housing and a second housing respectively supported by said first hanger block and said second hanger block, for amplifying and for emitting said external sound collected by said first microphone unit and said second microphone unit;

a first ear pad and a second ear pad provided at an auricle contact surface of said first housing and said second housing, respectively, for covering a left auricle and a right auricle when mounted on said user's head; and a power source for driving said first microphone unit and said second microphone unit and said first loud speaker unit and said second loud speaker unit.

2. The sound collector as set forth in claim 1, wherein said first microphone unit and said second microphone unit have a single orientation and are mounted on said first hanger block and said second hanger block, respectively, so as to be positioned in a vicinity of said left and right auricles when mounted on said user's head.

3. The sound collector as set forth in claim 2, wherein said first microphone unit is mounted at a position in a vicinity of said left auricle and said second microphone unit is mounted at a position in a vicinity of said right auricle, and said first loud speaker unit faces said left auricle and said second loud speaker unit faces said right auricle.

4. The sound collector as set forth in claim 1, wherein said first loud speaker unit and said second loud speaker unit amplify a sound signal collected by said first and second microphone units within a frequency band of approximately 2 to 3 kHz.

* * * * *